US005144922A

United States Patent [19]

Kong

[11] Patent Number: 5,144,922

[45] Date of Patent: Sep. 8, 1992

[54] FUEL IGNITION SYSTEM FOR COMPRESSION IGNITION ENGINES

[75] Inventor: Hakchul Kong, San Antonio, Tex.

[73] Assignee: Southwest Research Institute, San Antonio, Tex.

[21] Appl. No.: 608,010

[22] Filed: Nov. 1, 1990

[51] Int. Cl.[5] ..... F02P 19/02

[52] U.S. Cl. ..... 123/145 A

[58] Field of Search ..... 123/145 A, 179 H, 179 BG, 123/179 B

[56] References Cited

U.S. PATENT DOCUMENTS

| | | | |
|---|---|---|---|
| 2,840,067 | 6/1958 | Carlson | 123/145 A |
| 4,196,712 | 4/1980 | Kawamura et al. | 123/145 A |
| 4,322,604 | 3/1982 | Kawamura et al. | 123/145 A |
| 4,377,138 | 3/1983 | Mitani et al. | 123/145 A |
| 4,483,284 | 11/1984 | Andreasson | 123/145 A |
| 4,726,333 | 2/1988 | Verheyen | 123/145 A |
| 4,934,349 | 6/1990 | Demizu | 123/145 A |

FOREIGN PATENT DOCUMENTS 0315934 5/1989 European Pat. Off. ..... 123/145 A

OTHER PUBLICATIONS

"HR-H Series-Diagrams Lay-Outs," VM Electrical System, Jun. 1984.

"Low CO2 Car," Solication, Offer and Award, Environmental Protection Agency, May 10, 1990, Attachment H, pp. 7-8, 22-25.

*Primary Examiner*—Andrew M. Dolinar

*Attorney, Agent, or Firm*—Baker & Botts

[57] ABSTRACT

An improved fuel ignition system for a compression-ignited engine having a fuel combustion chamber and a glow plug located therein. The glow plug has a resistance heating element that is positioned in the combustion chamber. The resistance of the resistance heating element is sensed and compared with a set value. The result is utilized for the purpose of either varying the power supply to the glow plug or determining the length of on and off time for the glow plug while the engine is running.

7 Claims, 1 Drawing Sheet

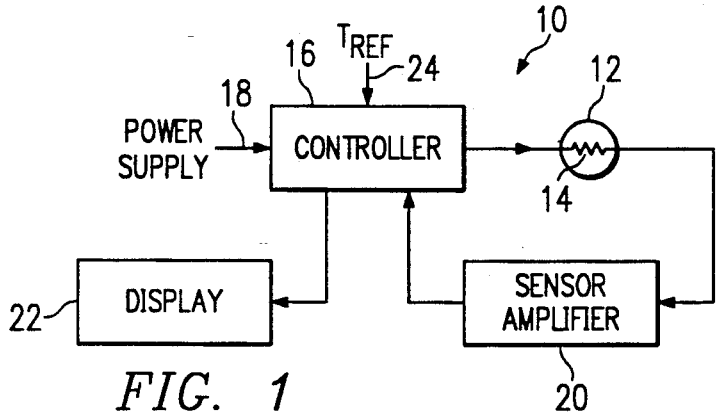
FIG. 1
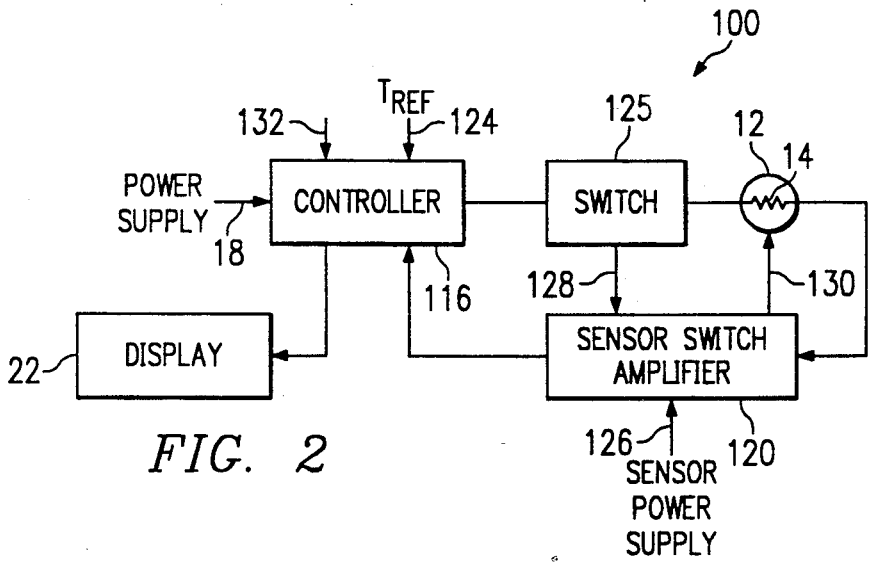
FIG. 2
FIG. 3
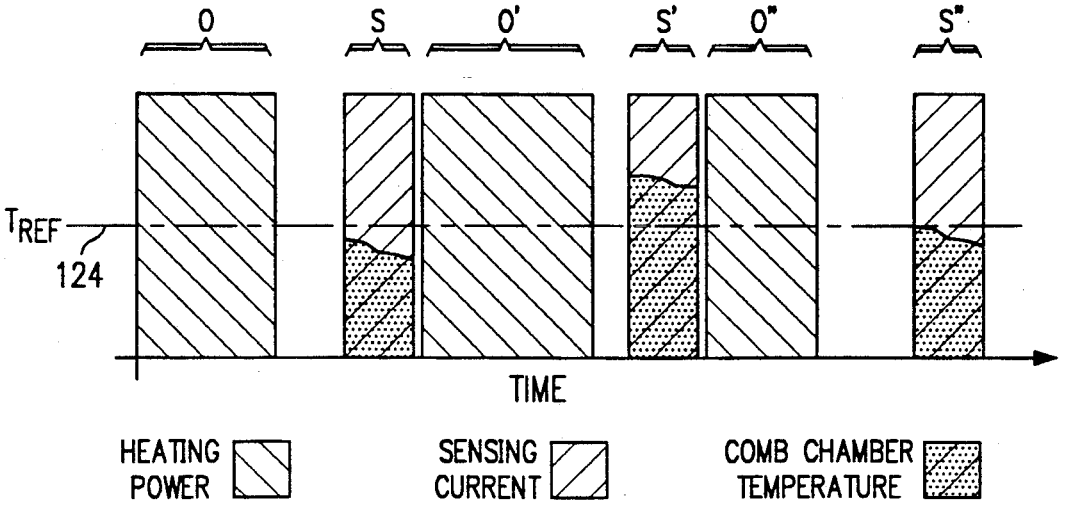

FUEL IGNITION SYSTEM FOR COMPRESSION IGNITION ENGINES

TECHNICAL FIELD OF THE DISCLOSURE

This invention relates generally to compression ignition engines. More particularly, but not by way of limitation, this invention relates to an improved fuel ignition system for a compression ignited engine.

BACKGROUND OF THE DISCLOSURE

Compression ignition engines have been in use for many years and are popularly known as "diesel" engines. In such engines, ignition occurs due to the compression energy and high pressure injection of fuel in the engine. Starting such engines is much easier when additional heat is provided to aid in igniting the fuel. Such additional heat may be supplied by increased combustion air temperature and/or the use of a device known as a glow plug which is essentially a resistance heating element placed in the combustion chamber of the engine.

Such arrangements have worked reasonably satisfactorily. However, and with the advent of alternative fuels and with the desire to introduce less contaminants into the atmosphere, it is desirable to provide such additional heat not only during initial engine startup but during the operation of the engine. The additional heat is particularly advantageous when supplied during startup of the engine and during the application of loads to the engine.

Some ignition systems have been proposed in the past for controlling the provision of additional heat during the combustion process until the engine reaches a certain temperature. Such systems have generally relied on sensing coolant temperature or the like. While these systems will operate, it should be understood that a substantial time delay occurs between changes in the temperature of the engine coolants and the events occurring in the engine combustion chamber. Also, ignition systems have been proposed which utilize special glow plugs and are thus not entirely satisfactory for retrofit on existing engines.

An object of this invention is to provide an improved fuel ignition system for compression-ignited engines that utilizes standard glow plugs for generating a signal to indicate the combustion chamber temperature and that accordingly can be retrofitted onto existing engines as well as manufactured into new engines.

SUMMARY OF THE INVENTION

This invention then provides an improved fuel system for a compression-ignited engine that has a fuel combustion chamber. The system comprises a glow plug having a resistance heating element located in the combustion chamber, a power source connected to the heating element for supplying power to the heating element to raise the temperature to aid in igniting fuel in the chamber, a sensor for sensing the heating element temperature and transmitting heating element signals proportionate thereto; and a controller. The controller transmits a signal that is indicative of the heating element temperature when the temperature in the combustion chamber a predetermined temperature, and varies the power supply to the heating element in response to the sensed temperature.

In another aspect, this invention provides an improved method for igniting fuels in a compression-ignited engine that includes a combustion chamber and glow plug having a heating element located in the chamber. The method comprises the steps of: supplying power to said heating element for heating the heating element to ignite fuel in the chamber, reducing the power supply to the heating element after a predetermined period of time, sensing the resistance change in the heating element due to the temperature changes in the combustion chamber, transmitting heating element signals proportional to the temperature change, increasing the power to the heating element in response to decreases in the temperature in the combustion chamber and decreasing the power of the heating element in response to increases the temperature of the combustion chamber.

BRIEF DESCRIPTION OF THE DRAWING

The foregoing and additional objects and advantages of the invention will become more apparent as the following detailed description is read in conjunction with the accompanying drawings wherein like reference characters denote like parts in all views and wherein:

FIG. 1 is a schematic diagram of a fuel ignition system that is constructed in accordance with the invention.

FIG. 2 is a schematic diagram of another version of the fuel ignition system that is also constructed in accordance with the invention.

FIG. 3 is a schematic diagram illustrating the sequence of events in the ignition control system of FIG. 2.

DETAILED DESCRIPTION OF THE EMBODIMENT OF FIG. 1

Referring to the drawing and FIG. 1 in particular, shown therein and generally designated by the reference character 10 is an improved fuel ignition system for a compression-ignited engine (not shown) that has a fuel combustion chamber. Located in the fuel combustion chamber is a glow plug 12 having a resistance heating element 14 located therein. The resistance heating element 14 is located in the combustion chamber.

The ignition system 10 also includes a controller 16 that is connected to the glow plug 12 and also to a power supply 18 for supplying electrical energy to the glow plug 12 to heat the resistance heating element 14. Connected to the resistance heating element 14 is a sensor/amplifier 20. The amplifier 20 is also connected to the controller 16.

As illustrated in FIG. 1, a digital display 22 is connected to the controller 16 and is arranged to display the temperature of the resistance heating element 14. The temperature of the heating element 14 will essentially be the temperature in the combustion chamber when element 14 is functioning to sense the temperature.

In the embodiment shown in FIG. 1, the controller 16 is actuated to supply power from the power supply 18 to the heating element 14. The power to the heating element 14 causes the temperature thereof to increase aiding in the initial ignition of the fuel in the engine during starting.

After a predetermined time, a switch in the controller reduces the power supplied to the heating element 14 to a preselected value so that the temperature of the element 14 changes to combustion chamber temperature and transmits a signal due to the change in resistance due to temperature changes. The sensor/amplifier 20 receives the heating element signal from the glow plug 12, which signal is amplified and transmitted to the controller.

Should the transmitted signal fall either above or below a reference temperature 24 which has been preset into the controller 16 or set by an external dial, the controller 16 either supplies additional power to the resistance element 14 or decreases the power thereto. If the temperature indicated is greater than the reference temperature 24, then the controller reduces the power transmitted to the heating element 14 and the heating element 14 cools. Such cooling is reflected as a heating element signal transmitted to the sensor/amplifier which is in turn amplified and sent back to the controller.

If desired, the transmitted signal is also sent to the digital display 22 so that the operator of the engine can visually determine the condition of the combustion chamber. In the event that the heating element signal drops below the reference temperature 24, the controller supplies additional power to the heating element 14, thus providing for combustion to occur more easily in the combustion chamber.

In general, the controller 16 and sensor/amplifier 20 are arranged so that the power supply to heating element 14 will be varied, depending on whether additional power is needed in the combustion chamber to cause a more complete combustion reducing the emission and causing the engine to operate more efficiently or less power is needed which will avoid burning out the glow plug 12.

DETAILED DESCRIPTION OF THE EMBODIMENT OF FIG. 2

FIG. 2 illustrates schematically another embodiment of a fuel ignition system for a compression-ignited engine that is constructed in accordance with the invention and is generally designated by the reference character 100. As shown therein, the system 100 includes the glow plug 12 having the resistance element 14 located within the combustion chamber (not shown). The glow plug 12 is connected to a controller 116 and the controller 116 is in turn connected to the power supply 18. Interposed in the conductor between the controller 116 and the glow plug 12 is a switch 125. The glow plug 12 is also connected to a sensor/switch/amplifier 120 which is in turn connected to the controller 116. The amplifier 120 is provided with a separate constant current power supply 126.

It will also be noted that the switch 125 is connected to the amplifier 120 by a conductor 128. A conductor 130 extends between the amplifier 120 and the glow plug 12.

If there were only one type of glow plug in use in the compression-ignited engines, a constant compensation signal 132 could be preset into the controller. However, there are many types and styles of glow plugs used in the engines and, to be certain that erroneous signals are not received by the controller 116, the compensation signal 132 has been adjusted and preset to alleviate the differences in design of the glow plugs and to compensate for the change in resistance in leads to the glow plug 12 when the engine is heating and cooling. The use of the compensation signal 132, while not essential, is a highly desirable feature on retrofit ignition systems. Such a compensation signal can also be used in connection with the system 10 illustrated in FIG. 1.

In operating an engine connected with the ignition system 100, the controller switch 125 is closed so that the power supply 18 supplies enough power to the resistance heating element 14 to aid in combustion of the fuel during starting of the engine. The heating element 14 will thus stay on until switch 125 is turned off or opened by a pulse width modification device contained within controller 116. The pulse width modulation device initially retains the switch 125 closed for a predetermined period of time or a temperature command set by the engine control module or an external dial.

Closing of the switch 125 sends a signal through the conductor 128 to the amplifier 120. Such signal causes the switch in the amplifier 120 to open with respect to the sensor power supply 126 so that no current is being transmitted through the conductor 130. Upon the passing of the predetermined period of time, the switch 125 opens, closing the switch in the amplifier 120.

Opening of the switch 125 shuts off a power supply to the resistance heating element 14. When this occurs, the sensor power supply 126 sends a constant current to the glow plug 12. A constant current is imposed across the heating element 14 and the temperature in the combustion chamber due to the fuel ignition therein is reflected as a voltage and as a heating element signal which is transmitted to the amplifier 120. In the amplifier 120, the signal is amplified and sent back to the controller 116.

Upon receipt of the signal from the amplifier 120, the controller 116 compares the signal to a reference temperature 124 that has been preset in the controller 116 so that the pulse width modification device in the controller 116 determines the amount of time the switch 125 should be closed to provide the power for heating the heating element 14.

The above cycle can be appreciated more fully by viewing FIG. 3. In FIG. 3, the heating cycle, sensing cycle, and the temperature of the combustion chamber are overlayed on a single graph.

From left to right in FIG. 3, the first heating cycle or "on" cycle is indicated by the letter "O". The switch 125 is turned off after a predetermined time and the sensing cycle S begins. During the sensing cycle S, the switch in the amplifier 120 is closed and the temperature of the combustion chamber is sensed, as indicated on the graph. In the controller 116, the combustion chamber temperature is compared to the reference temperature 124. As indicated in FIG. 3, the initial temperature is below the reference temperature 124 and, thus, the controller 116 extends the second "on" cycle O' during which time the resistance element 14 is being heated for a time longer than in the first cycle O. At the end of this period of time, the amplifier 120 comes on and the switch 125 opens so that the sensing cycle S, begins. As indicated on the graph of FIG. 3, the temperature of the combustion chamber is above the reference temperature 124 during the cycle S'. This temperature is utilized in the controller 116 to shorten the on time O' so that the heating cycle of the resistance element 114 is not so long as the on cycle O'.

The advantage of such a system is that the heating element 14 is heated as necessary to maintain the combustion chamber temperature near the reference temperature. The combustion chamber temperature is maintained at or near the optimum providing the maximum efficiency of the engine and a substantial reduction in pollutants ejected into the atmosphere. The reference temperature utilized will not be a single temperature in all cases, but will be changed depending upon the speed of the engine and the load imposed thereon.

From the foregoing, it will be appreciated that the systems described control the temperature of the glow plug and the temperature of the combustion chamber without the necessity of extra sensors being provided, aids the engine during startup or during cold start with low compression, improves the combustion quality during normal operation, shortens warmup time after starting, and extends the life of glow plugs since they are only "on" for the necessary amount of time during the pulse width modulated duty cycle. In addition, as glow plug deterioration occurs, and if indeed there is a discrepancy between the glow plugs, the system automatically controls the heating time through sensing the combustion temperature and thus ignores such discrepancy. In the event that alternative fuel is utilized in the engines, the glow plug heating time is automatically adjusted since the sensor is related to combustion chamber temperature and thus the glow plug automatically switches on or off to maintain such temperature for the alternative fuel. The temperature may also vary since it will be different for each engine for a specific fuel at different engine speeds and loads.

It will be understood that while the invention has been described in detail hereinbefore, that many modifications and changes can be made thereto without departing from the spirit or scope of the invention.

What is claimed is:

1. An improved fuel ignition system for a compression-ignited engine having a fuel combustion chamber, said system comprising:

a glow plug having a body and a resistance heating element located in the combustion chamber;

a power source connected to said heating element for supplying power to said heating element to raise the temperature of said heating element to aid in igniting fuel in said chamber;

sensor means for sensing the heating element temperature and for transmitting a heating element signal proportional thereto;

control means connected to said power source and to said sensor means for receiving said heating element signal to determine an on duty time period for supplying power from said power source to said heating element in proportion to the heating element temperature when the temperature in said chamber differs from a predetermined temperature, said control means includes a pulse width modulator for supplying an on duty cycle signal to said power source based on said on duty time period; and compensating means connected to said control means for obviating errors due to the effects of resistance changes in the glow plug body and in lead wires connected to said sensor means.

2. The system of claim 1 and also including amplification means for amplifying said heating element signal.

3. The system of claim 2 and also including temperature indicator means connected to receive said heating element signal for displaying the temperature of said heating element.

4. An improved fuel ignition system for a compression-ignited engine having a fuel combustion chamber, said system comprising:

a glow plug having a body and a resistance heating element located in the combustion chamber;

an electrical power source connected to said heating element for supplying power to said heating element to raise the temperature of said heating element to aid in igniting fuel in said chamber;

sensor means for sensing the heating element temperature when said heating element is off and for transmitting a heating element signal proportional thereto;

control means for receiving said heating element signal and transmitting a pulse width modulated signal having an on duty cycle for said electrical power source to the heating element temperature when the temperature in said chamber differs from a set value; and compensating means connected to said control means for obviating errors due to the effects of resistance changes in the glow plug body and in lead wires connected to said sensor means.

5. The system of claim 4 and also including amplification means for amplifying said heating element signal.

6. The system of claim 5 and also including a constant current source connected to said sensor means for supplying a constant sensing current to said glow plug.

7. The system of claim 5 and also including temperature indicator means connected to receive said heating element signal for displaying the temperature of said heating element.

* * * * *

UNITED STATES PATENT AND TRADEMARK OFFICE

CERTIFICATE OF CORRECTION

PATENT NO. : 5,144,922

DATED : September 8, 1992

INVENTOR(S) : Hakchul Kong

It is certified that error appears in the above-identified patent and that said Letters Patent is hereby corrected as shown below:

Column 1, line 64, after "chamber" insert -- differs from --.

Column 4, line 54, after "cycle" delete "S," and insert -- S' --.

Signed and Sealed this

Nineteenth Day of October, 1993

*Attest:*

*Attesting Officer*

BRUCE LEHMAN

*Commissioner of Patents and Trademarks*